United States Patent [19]

Lapcevic

[11] Patent Number: 4,982,956

[45] Date of Patent: Jan. 8, 1991

[54] VARIABLE RESISTANCE EXERCISE APPARATUS

[76] Inventor: Thomas G. Lapcevic, 1411 Grandview Ave., Apt. 808, Pittsburgh, Pa. 15211

[21] Appl. No.: 332,836

[22] Filed: Apr. 3, 1989

[51] Int. Cl.[5] ..... A63B 21/062

[52] U.S. Cl. ..... 272/118; 272/134

[58] Field of Search ..... 272/117, 118, 123, 134

[56] References Cited

U.S. PATENT DOCUMENTS

| | | | |
|---|---|---|---|
| 4,709,920 | 12/1987 | Schnell | 272/117 |
| 4,711,448 | 12/1987 | Minicow et al. | 272/118 |
| 4,836,536 | 6/1989 | Jones | 272/134 |

*Primary Examiner*—Robert Bahr

*Attorney, Agent, or Firm*—Reed Smith Shaw & McClay

[57] ABSTRACT

An exercise apparatus in which the resistance force experienced by the exerciser may be varied is provided. The apparatus includes a support frame within which a weight support carriage having detachable weight members is supported for vertical movement. A shaft is rotatably mounted on the frame and an exercise bearing member which may be engaged by a user is secured to the shaft as well as a cable wheel having a peripheral cable guide track. A length of cable is secured at one end to the weight support carriage, reeved through cable guides and movably attached at its other end to the cable wheel. A supplemental cam member having a varying thickness is received within the guide track and is movable therein along guide members. The position of the supplemental cam member may be fixed at predetermined points along the guide track in order that the cable must ride thereon, thereby providing exercise resistance or force which varies with the thickness of the supplemental cam member. Alternatively, the supplemental cam member may be provided on the cable wheel of an apparatus wherein the exerciser directly engages a cable. Also disclosed are embodiments including variable moment arms as well as gearing to vary resistance patterns by the effect of their ratios.

20 Claims, 12 Drawing Sheets

VARIABLE RESISTANCE EXERCISE APPARATUS

BACKGROUND OF THE INVENTION

1. Field of the Invention

The present invention relates to exercise apparatuses and, in particular, to an exercise apparatus in which the resistance encountered during the exercise motion may be varied to follow an indefinite number of predetermined patterns.

2. Description of the Invention Background

As discussed in my copending U.S. Pat. application Ser. No. 269,517, filed Nov. 10, 1988, the disclosure of which is incorporated herein by reference, exercise apparatuses or weight lifting machines have previously been developed whereby an exerciser who desires to develop certain body muscles employs such muscles to overcome resistance forces provided by the device However, many prior art apparatuses provide only a constant resistance force during the exercise. It has been discovered that it is desirable to consider specific physical conditions of muscles during an exercise by varying the resistance encountered during the exercise motion. Unfortunately, the availability of exercise apparatuses capable of providing adjustable resistance patterns is limited at present.

For example, in what will be referred to as a "standard" weight lifting apparatus, there is provided a main support frame having upright members interconnected with crossmembers; a weight support carriage vertically movable within the main frame; a cable guide means fixed to the main frame; a length of cable secured at one end to the weight support carriage and reeved about the cable guide means; and a gripping means such as a handle which is secured to the free end of the cable for grasping by an exerciser to transmit force to vertically move the weight support carriage. As such, the resistance experienced by the user is the constant downward force of gravity on the weight support carriage. Thus, the resistance force is constant throughout the exercise movement and does not vary to achieve the benefits of maximum and minimum resistance at selected segments of the exercise cycle.

In an alternative embodiment of the "standard" exercise apparatus, the free end of the cable is attached to a cable wheel having a circular arcuate segment which is attached to a rotatable shaft supported on the main support frame. A bearing surface or surfaces, such as a leg extension pad, is also attached to the rotatable shaft by a bracket member in order that the user may apply force against the bearing surface to rotate the shaft and, hence, the cable wheel against the force of gravity which acts by means of the cable on the weight support member. As such, the resistance encountered by the exerciser in motivating the bearing surface is constant because the cable wheel arc segment is of a constant radius and the force thereby created by the weight support carriage applies a constant resistant torque thereto.

In an effort to provide a single variable resistance pattern in the last-described apparatus, Applicant believes that those in the art have replaced the circular cable wheel arc segment with a non-circular cam wheel which is rotatably mounted on the shaft and which has the cable attached thereto. As such, the cam wheel has a varying radius so that the moment arm formed at the point of tangency of the cable on the cam wheel varies during the exercise motion thereby varying the resistance. However, because the resistance is determined only by the shape of the cam wheel in such apparatus, in order to present alternative resistance patterns, the cable must be detached from the cam wheel, the cam wheel removed from the shaft and replaced by a replacement cam wheel, and the cable reattached to the replacement cam wheel. In addition to the time and effort required in changing cam wheels, a plurality of cam wheels is required to provide varying resistance patterns.

Apparently in an effort to provide varying effective cam surfaces which are connected to the weighted cable and which rotate on the rotatable shaft, the apparatus disclosed in U.S. Pat. No. 4,709,920 issued to Josef Schnell on Dec. 1, 1987 was developed. In that apparatus, the cable is attached between two spaced parallel disks having cooperating apertures therein. The user apparently places pins between the disks to define the cam surface between the disks which encounters the weighted cable. By varying the pin placement, the cam surface and, hence, the resistance pattern, may be varied. It is clear to those skilled in the art that such a system is fraught with serious practical shortcomings. First, the proper placement of the pins between the disks to generate a cam surface appears difficult for many users. Second, the time and effort in selecting and effecting pin placement is excessive. In addition, because the cable passes over a highly discontinuous surface defined by the pins, the smooth action required for effective and safe muscle development may be lacking.

The subject invention is directed toward an improved exercise apparatus allowing for readily variable resistance patterns which overcomes, among others, the above-discussed problems and provides an exercise apparatus presenting selectable effective cam surfaces connected to a cable coupled to a weight stack which allows for proper development or rehabilitation of an exerciser's musculature.

SUMMARY OF THE INVENTION

In accordance with the present invention, there is provided an exercise apparatus which may present constant or varying resistance patterns for an exerciser. The exercise apparatus disclosed includes a free-standing support frame having interconnected vertical and horizontal frame members. A weight support carriage is supported within the support frame for vertical movement along guide bars. The weight support carriage includes a plunger bar means for detachably supporting weight members. A horizontal shaft is rotatably attached to the frame and an exercise bearing member to which the user applies the exercise force is secured to the shaft by a bracket. In addition, a circular cable wheel is affixed to the shaft. A length of cable is secured at one and to the weight support carriage and at its other end is releasably attached to the cable wheel and its remainder is reeved about the cable guide means.

The cable wheel includes a cable guide channel having upstanding cable guide walls and a lower cable receiving surface. Additionally, a movable supplemental cam member of a specified length is provided. The supplemental cam member is slideably received within the cable guide channel on track means and means are provided for locking the supplemental cam surface to the cam wheel. The supplemental cam surface also includes upstanding cable guide walls and a gradually elevated cable receiving surface. As such, the supplemental cam member alters the radius of the point of tangency of the cable to the cam wheel by presenting an elevated surface at predetermined points in the exercise motion. In addition, by varying the shape of a supplemental cam member or by stacking more than one supplemental cam member, alternative resistance patterns are available.

Accordingly, the present invention provides a weight lifting exercise apparatus in which selectable segments of increased resistance may be provided during the exercise motion. Because this invention provides changeable resistance patterns to the exerciser, he or she may develop musculature in a more beneficial manner. In addition, the means for providing varying resistance may be readily employed which encourages implementation of the advantages of this invention.

These and other details, objects and advantages of this invention will become apparent as the following description of the present preferred embodiment thereof proceeds.

BRIEF DESCRIPTION OF THE DRAWINGS

In the accompanying drawings, I have shown a present preferred embodiment of the invention wherein.

DETAILED DESCRIPTION OF THE PREFERRED EMBODIMENTS

Figure 1:
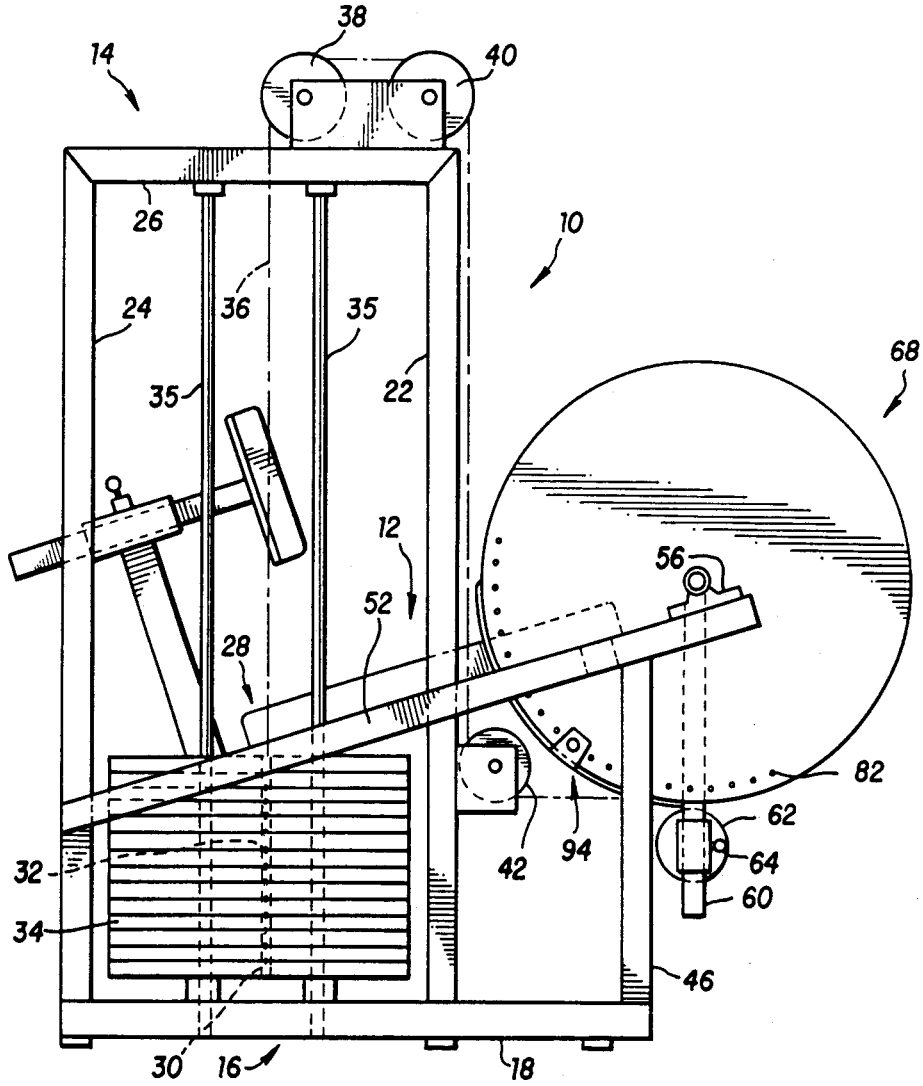
FIG. 1 is a side elevation view of the apparatus according to the present invention.

Referring now to the drawings wherein the showings are for purposes of illustrating the present preferred embodiments of the invention only and not for purposes of limiting same, the Figures show a weight lifting apparatus 10 having an exercise station 12 which may be occupied by an exerciser.

The exercise apparatus 10 includes a main framework 14 which includes a base 16 of lateral base frame members 18 and longitudinal frame members 20 suitable for support on a floor surface. The framework 14 also includes parallel forward and rear vertical frame members 22 and 24, respectively, which support an upper longitudinal frame member 26. Disposed within the framework 14 is a weight support carriage, generally shown as 28, which includes a plunger bar 30 having apertures along its length for receiving a pin 32 which may be disposed beneath any one of a selected number of weight plates 34 in known manner to establish a base resistance force. The vertical movement of weight plates 34 is guided by vertical guide bars 35.

The upper end of the plunger bar 30 is connected to one end of a length of cable, shown as 36, which is reeved about first and second pulleys 38 and 40, respectively, which are rotatably mounted on upper frame member 26. Cable 36 is also reeved around a third pulley 42 rotatably mounted on the lower portion of front vertical frame member 22.

The framework 14 also includes lateral vertical frame members 44 and 46, respectively, which cooperate to support a horizontal member 48. A first inclined member 50 is supported by horizontal member 48 while a second inclined member 52 is supported by lateral frame member 46. The first inclined member 50 serves to support a first pillow block 54 or other similar bearing means. Additionally, the second inclined member 52 supports a second pillow block 56. Rotatably supported by first pillow block 54 and second pillow block 56 is a rotatable shaft 58. Securely attached to rotatable shaft 58 is a bracket 60 which supports a bearing member 62 which is engaged by the exerciser during the exercise movement and whose position may be varied along bracket 60 by means of a pop pin 64 which may engage apertures 66 in bracket 60. For example, bearing member 62 may comprise a horizontal padded cylindrical member which is engaged by an exerciser for rotation about the shaft 58 in what is typically referred to as a leg extension exercise.

Also attached to shaft 58 is a circular cable wheel 68. Cable wheel 68 comprises a circular member having a cable guide channel 70 formed about its circumference. As such, cable guide channel 70 serves to guide and receive cable 36 upon cable wheel 68 during the rotation of cable wheel 68 about shaft 58. Cable guide channel 70 includes an inner wall member 72, an outer wall member 74 and the cable receiving surface 76 defined there- between. In addition, annular guide grooves 78 are provided on inner cable wheel wall 72, and outer guide grooves 80 are provided on outer cable wheel wall 74 for purposes to be described hereinbelow. Additionally, a series of spaced apertures 82 are provided about the periphery of over 180 degrees of outer cable wheel wall 74, again, for purposes which will become apparent below.

In order to attach one end of the cable 36 to the cable wheel 68, cable attachment means, generally indicated as 84, are provided. In addition, apertures 86 are provided about the circumference of inner cable wheel wall 72. Cable attachment means 84 includes a positionable housing member 88 which has one end of cable 36 secured thereto. Positionable housing member 88 includes protruding guide members 89 which may engage inner cable wheel wall guide tracks 78 and outer cable wheel guide tracks 80, thereby securing the positionable housing member 88 from removal from the cable wheel 68. Additionally, a pop pin 90 is provided on positionable housing member 88 and includes an outer protruding portion which may be engaged by a user and an inner extending shaft which may engage apertures 86 in inner cable wheel wall 72. Accordingly, the aperture 86 which receives the pop pin 90 determines the initial location of the cable 36 relative to cable wheel 68. For purposes which will become apparent below, Applicant has discovered that it may be desirable to provide additional slack in cable 36 and such slack may be provided by adjusting cable attachment means 84. In addition, for certain applications I choose to attach a bushing to the end of cable 36 which extends laterally of housing member 88 in order that I may rotate the cable attachment means 84 through 360 degrees or less on cable wheel 68 to allow for variations in the arc it traverses during the exercise movement, including allowing the revolution of cable wheel 68 to occur in the opposite direction.

As such, during the normal operation of exercise apparatus 10, the exerciser occupies exercise station 12 and exercises by engaging the bearing member 62 and causing it to rotate about shaft 58. Because the cable 36 is connected at one end to the cable wheel 68 mounted on shaft 58 and the other end of the cable 36 is secured to the weight support carriage 28, the weight thereof serves to resist the rotation of shaft 58 by a torque equal to the weight of the applied weight members 34 multiplied by the distance from the center of shaft 58 to the point of tangency, hereinafter called 92, of the cable 36 with the cable wheel 68. By means of example, the shaft 58 may rotate 120 degrees in either direction during an exercise cycle.

In order to vary the resistance torque experienced by the exerciser during the exercise motion, I have developed a supplemental cam member, generally designated as 94, which may be secured to cable wheel 68 to vary the effective radius of the point of tangency 92 from shaft 58. In particular, supplemental cam member 94 consists of an arcuate body member 96 which fits within cable guide channel 70. Supplemental cam member 94 may, for example, include an arc of 60 degrees to modify the cable receiving surface 76 if the exercise motion is 120 degrees. Body member 96 has a mating surface 97 which conforms to and rides upon cable receiving surface 76. Body member 96 includes inner and outer guide walls, 98 and 100, respectively, which laterally surround a central member 102. Central member 102 is provided with an elevated cam receiving surface **72*a* on which the cable 36 may pass. Thus, cam receiving surface 72*a* may serve as a gradual modification of cam receiving surface 72 to vary the radius of tangent point 92** and, hence, the effective resistance experienced by an exerciser.

In order to retain supplemental cam member 94 on cable wheel 68, inner and outer guide walls 98 and 100, respectively, include runner segments 104 and 106, respectively, which engage inner wall guide tracks 78 and outer wall guide tracks 80, respectively. As such, supplemental cam member 94 is displaceable within cable guide channel 70. To fix the position of supplemental cam member 94 relative to the cable wheel 68, a pop pin 108 is provided on body member 96. Pop pin 108 includes a handle 110 which may be engaged by a user to move a pin 112 attached thereto. Pin 112 is provided to pass through an aperture in housing 114 of pop pin 108 and into any one of the outer apertures 82 on cable wheel 68. Accordingly, supplemental cam member 94 may be attached to cable wheel 68 at various points thereon by merely aligning pop pin 108 with any selected inner aperture 82.

The disclosed apparatus 10 may be employed to provide predetermined segments of varied resistance during the exercise cycle. Such is the case because the supplemental cam member 94 serves to increase the radius acted upon by the force applied to cable 36 by the weight members 34. As such, the exercise apparatus 10 may provide for maximum resistance force at either the beginning, end or intermediate portions of the exercise cycle.

Figure 3:
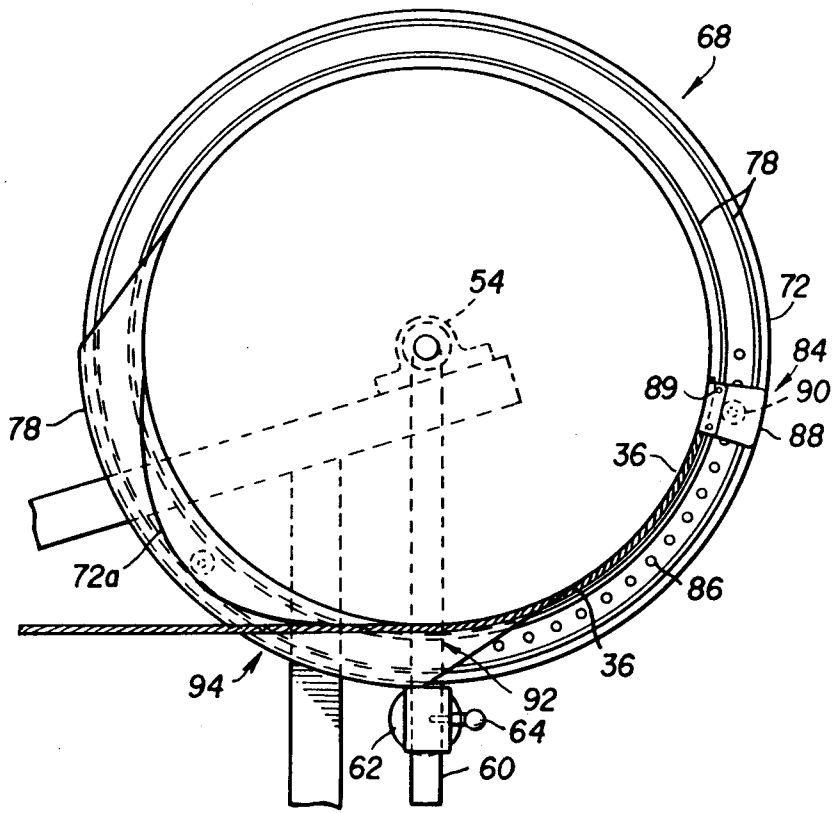
FIG. 3 is a detailed side elevation view of certain components of the invention.
Figure 5:
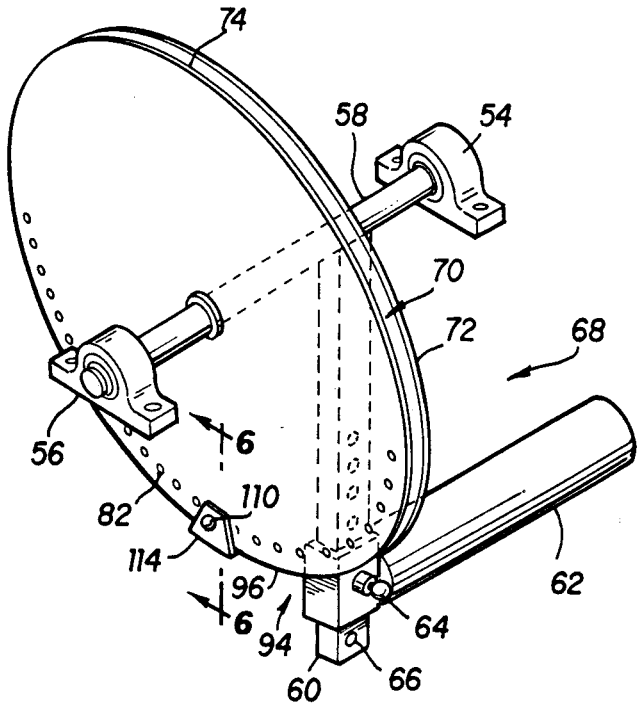
FIG. 5 is an isometric rendering of components of the device disclosed herein.
Figure 6:
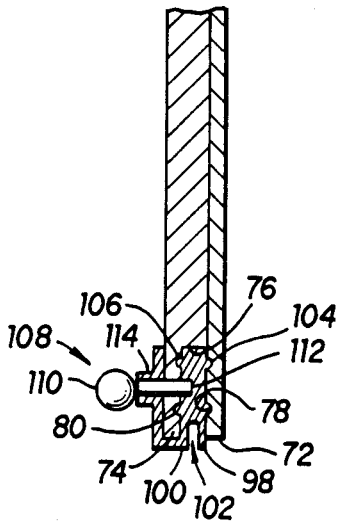
FIG. 6 is a sectional view taken along lines 6—6 in FIG. 5.
Figure 7:
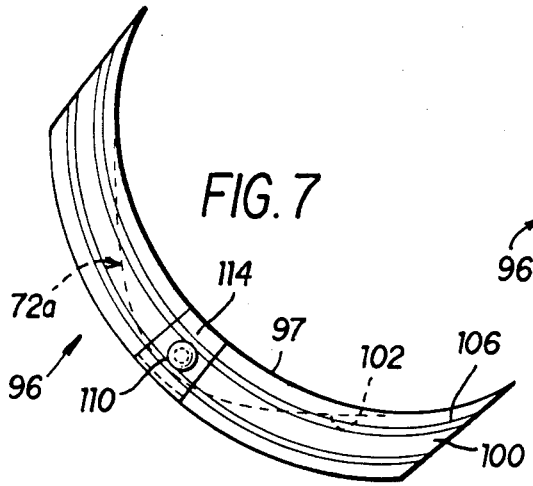
FIG. 7 is a side view of the supplemental cam member disclosed herein.
Figure 8:
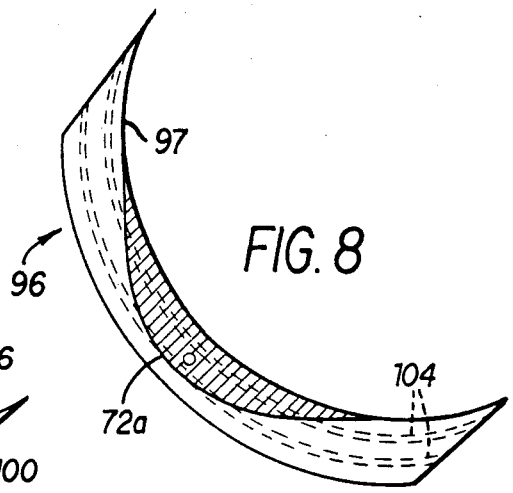
FIG. 8 is a side sectional view of the supplemental cam member.
Figure 9:
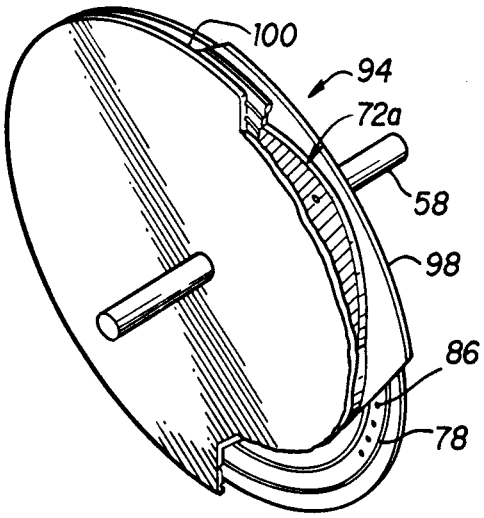
FIG. 9 is a partial cut-away view of components of the instant invention.
Figure 11:
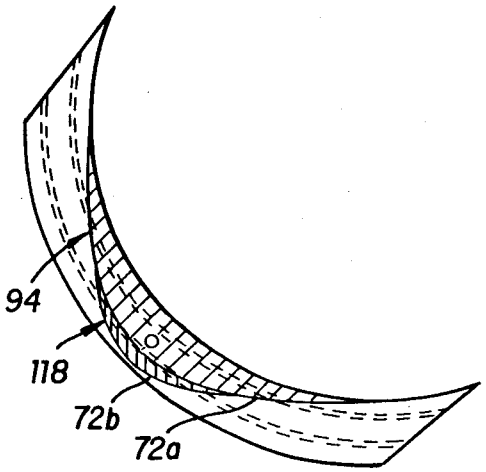
FIG. 11 is a side sectional view of an alternate supplemental cam member.

In the event the exerciser requires increased resistance at the central portion of the exercise cycle, again assuming a 120 degree exercise motion, the pop pin 108 on cam member 94 is loosened and cam member 94 is displaced along cable guide channel 70 until the maximum thickness of cam member 94 corresponds to that point which is 60 degrees into the exercise motion. The pop pin 108 is then caused to engage the aperture 82 corresponding to such position. Viewing FIG. 3 for exemplary purposes, during the resistance phase of the exercise motion, an exerciser would cause the bearing member 62, and, hence, shaft 58 and cable wheel 68, to move in a counterclockwise direction. If the exerciser required maximum resistance at the mid-point of a 120 degree exercise cycle, he or she would move the cam member 94 clockwise so that its point of maximum thickness was 60 degrees beyond the point of tangency 92. In the event the exerciser required maximum resistance at the end of the resistance portion of the exercise motion, the cam member 94 would be placed so that its point of maximum thickness corresponds to that point on cable wheel 68 which is 120 degrees from the point of tangency 92.

I have also discovered that in the event maximum exercise resistance is required at the outset of the exercise motion, whereby the cam member 94 is disposed with its maximum thickness upon the initial point of tangency 92, the cable 36 must be lengthened to compensate for the increased initial effective radius of the cable wheel 68. Rather than endeavor to increase the length of cable 36 at the weight support carriage 28, in order to provide such additional length to cable 36, pop pin 90 of cable attachment means 84 is released and cable attachment means 84 is displaced clockwise until the cable 36 may pass about supplemental cam member 94 and pop pin 90 is reattached to the corresponding inner aperture 86.

Of course, if the exerciser elects to have constant resistance throughout the exercise motion, the supplemental cam member 94 may be displaced clockwise so that no portion thereof is within the exercise motion and it may be secured in such position bY locking pop pin 108 into an appropriate aperture 82.

Having described the present preferred embodiment of the basic form of this invention, additional preferred embodiments will now be discussed. Although the supplemental cam member 94 is positionable along cable wheel 68 to cause increased resistance force at a plurality of points therealong, because the maximum thickness of supplemental cam member 94 is defined, its maximum effect on the resistance force is also defined. In order to allow for greater or lesser maximum resistance, alternative supplemental cam members having greater or lesser thickness, respectively, may be substituted for the original supplemental cam member 94. To allow for the use of substitute supplemental cam members 94, I prefer to permit any given supplemental cam member 94 to be removable from cable wheel 68 by means of a notch 116 in the periphery thereof. As will be appreciated by those skilled in the art, notch 116 serves to allow guide runners 104 and 106, respectively, of supplemental cam member 94 to be removed from inner and outer guide tracks 78 and 80, respectively. Alternatively, a second supplemental cam member 118 may be attached to supplemental cam member 94 by means disclosed herein to permit a greater effective radius to be recognized.

In accordance with this invention, there is also provided an alternative form of a supplemental cam member, shown as 120, whose thickness increases, then decreases, then increases and then decreases to provide two (2) points of maximum resistance. Of course, any alternative form of supplemental cam member may be applied and secured to cable wheel 94 by the means disclosed herein.

Figure 13:
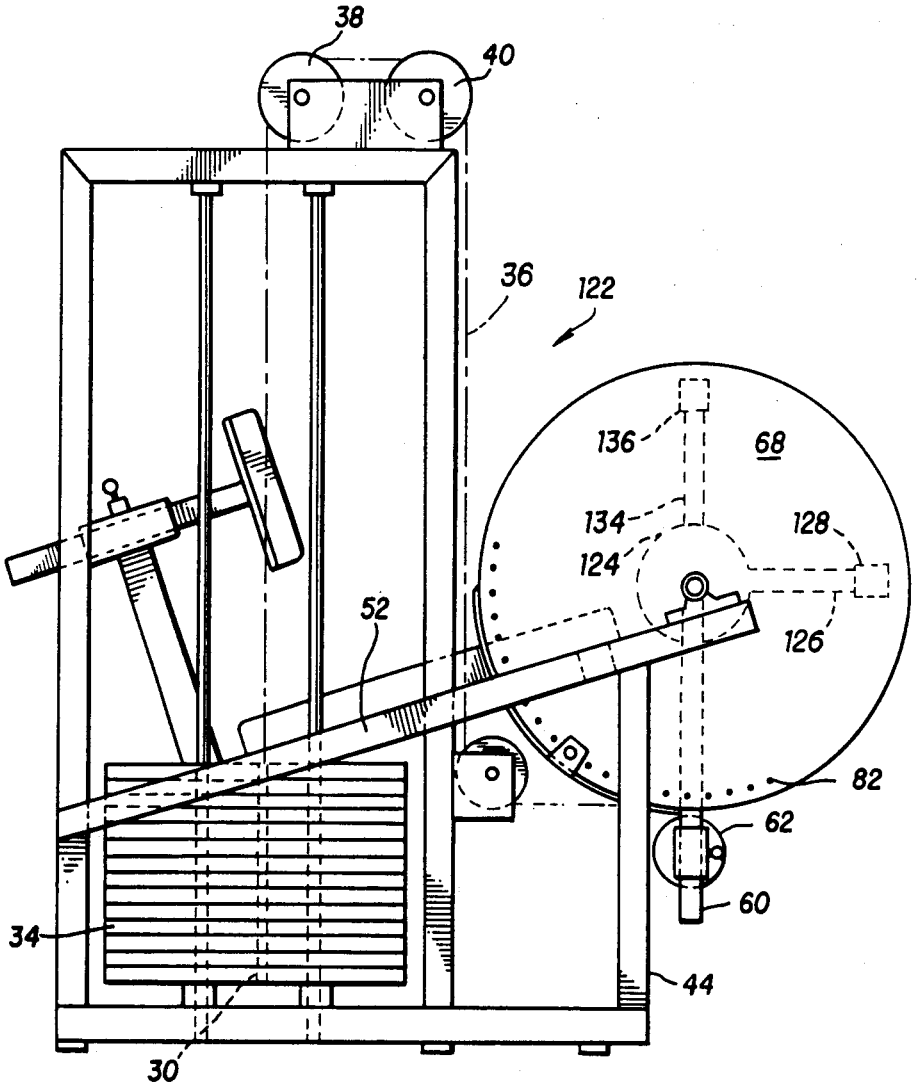
FIG. 13 is a side elevation view of an alternative embodiment of the invention.
Figure 14:
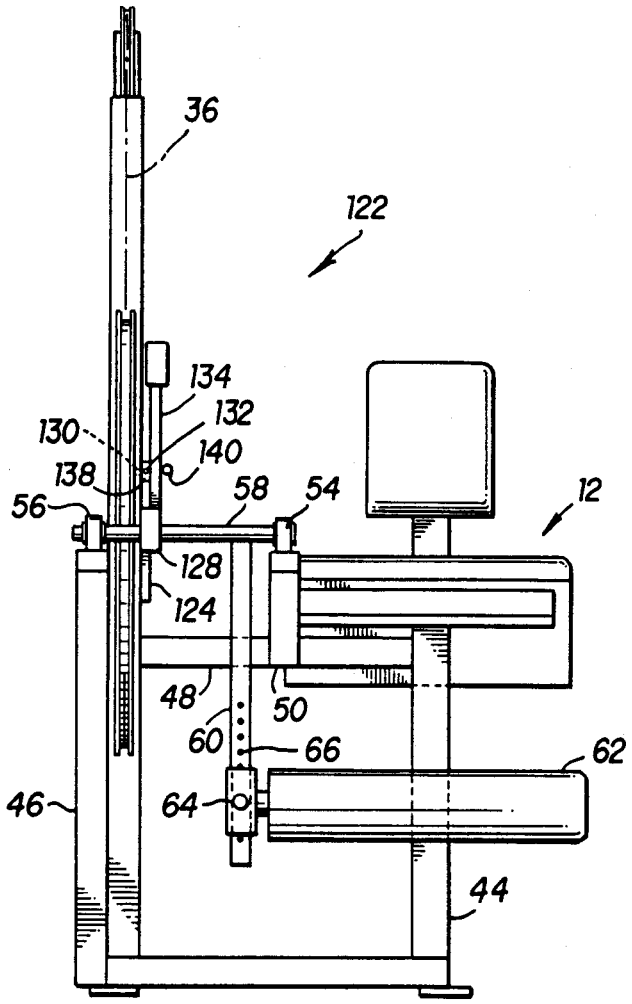
FIG. 14 is a front elevation view of an alternative embodiment of the invention shown in FIG. 13.

In order to provide an exercise apparatus with which the resistance patterns may be varied to an even greater degree, I provide the apparatus generally shown in FIGS. 13 and 14 as 122 wherein like components bear reference numerals presented above. In such apparatus, the principles disclosed in my copending U.S. Pat. application Ser. No. 269,517 are combined with the disclosures hereof. Specifically in such embodiment, there is provided a disk member 124 which is rotatably mounted on shaft 58. Disk member 124 has secured thereto a first moment arm 126 which has a first weight member 128 selectably positionable thereon. Also, apertures 130 are provided about an inner radius on cable wheel 68 which may be engaged by a pop pin 132 on disk member 124 to secure disk member 124 to cable wheel 68 in a predetermined orientation. Further, I prefer to provide a second moment arm 134 adjacent to disk member 124 which is also rotatable relative to shaft 58. Second moment arm 134 has a second weight member 136 mounted thereon in selectable positions. In order to secure second moment arm 134 to disk member 124, apertures 138 are provided thereon which may be engaged by a pop pin 140 mounted on second moment arm 134.

Based on the disclosures of my copending U.S. Pat. application Ser. No. 269,517, which are incorporated herein by reference, and those of the instant disclosure, those skilled in the art will begin to appreciate the flexibility of exercise cycles made possible by exercise apparatus 122. For example, if the benefits of the moment arms 126 and 134 are desired to be exploited without the benefits of the supplemental cam member 94, the supplemental cam member 94 may simply be displaced to a point along cable wheel 68 at which it will not be engaged by the cable 36. However, if the moment arms 126 and 134 are used in conjunction with the supplemental cam member 94, practically an infinite number of resistance patterns are available.

Figure 15:
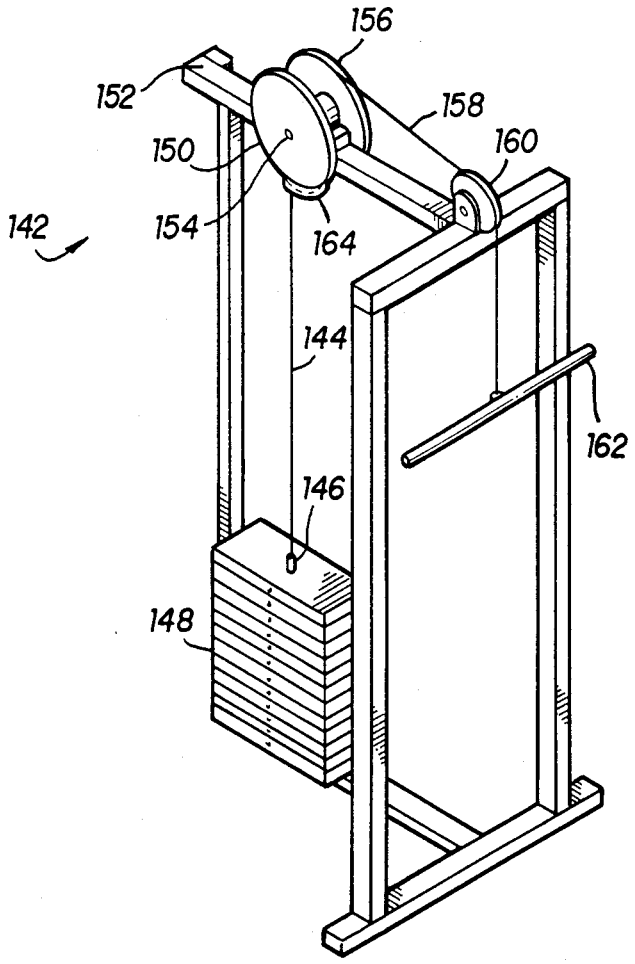
FIG. 15 is an isometric view of another embodiment of the invention.

In yet another embodiment of the invention shown in FIG. 15, an exercise apparatus 142 is provided with which the exerciser performs only linear exercise movements. In such an apparatus, a first cable 144 is secured to a plunger bar 146 which may support any of a predetermined number of weight members 148. The cable is secured to a first cable wheel 150 which is rotatably supported on a frame 152 by means of a shaft 154. Also secured to the shaft 154 is a second cable wheel 156 which has a second cable 158 attached thereto. Second cable 158 is reeved about a pulley 160 and is secured at its other end to a bar 162 or other apparatus for engagement by an exerciser.

In order to provide variable resistance force in apparatus 142, I prefer to provide first cable wheel 150 of a design similar to that discussed above relative to cable wheel 68 and to provide a supplemental cam member 164 for use thereon, in a manner similar to that disclosed above. As will now be appreciated by those skilled in the art, when an exerciser displaces bar 162, second cable 158 rotates second cable wheel 156 which rotates shaft 154 which, in turn, rotates first cable wheel 150 to cause the vertical displacement of the weights 148. However, due to the provision of supplemental cam member 164, the radius of first cable wheel 150 is modified to thereby increase the exercise resistance at specified points in the exercise cycle. It will be appreciated that a supplemental cam member may alternatively be provided on second cable wheel 156 or may be provided on both cable wheels 150 and 156 to provide for additional flexibility in tailoring exercise resistance patterns.

Figure 16:
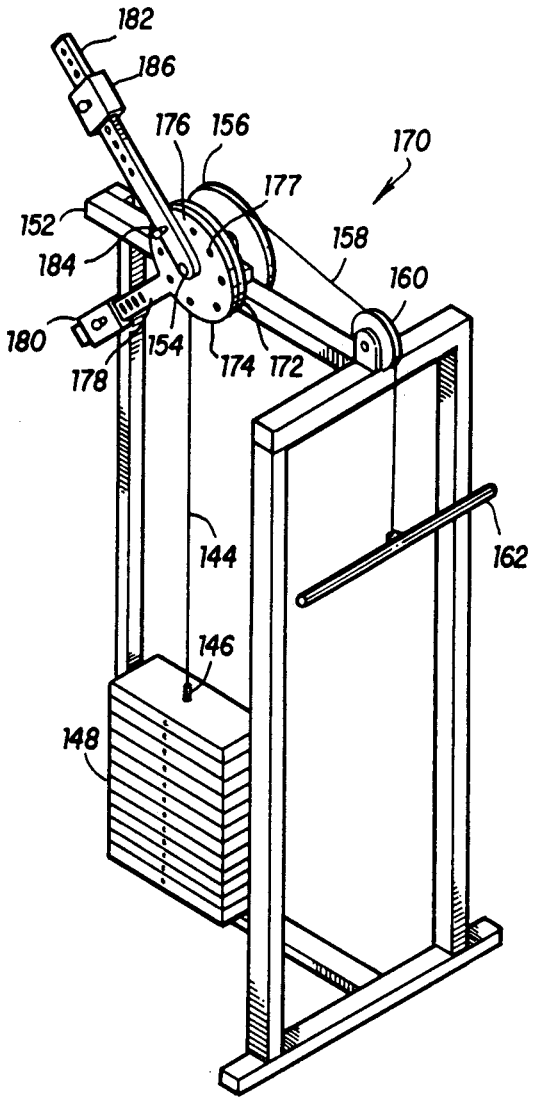
FIG. 16 is an isometric view of yet another embodiment of this invention.

Another embodiment of the present invention, shown in FIG. 16 as 170, bears certain similarities to that embodiment shown in FIG. 15, and, as such, like reference numerals appear in FIG. 16 for like components. However, in place of first cable wheel !50, I choose to provide a first cable wheel 172 on shaft 154. First cable wheel 172 has apertures (not shown) disposed peripherally thereabout. In addition, a second disk 174 is provided parallel and adjacent to first cable wheel 172 and is rotatable on shaft 154. Second disk 174 includes apertures 176 which may be aligned with the apertures on first cable wheel 172 and secured thereto by means of a pop pin 177.

Extending from first cable wheel 172 is a first moment arm 178 having a first weight member 180 securable thereon at various positions. Also rotatably supported on shaft 154 adjacent to second disk 174 is a second moment arm 182. Second moment arm 182 is provided with a pop pin 184 to selectively secure it to apertures 176 of second disk 174. In addition, a second weight member 186 is provided on second moment arm 182 so as to be positionable thereon at various points.

Figure 12:
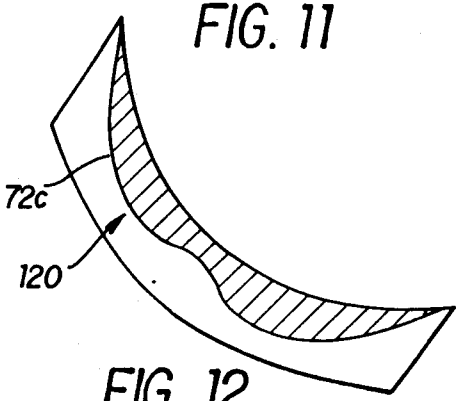
FIG. 12 is a side sectional view of another supplemental cam member.
Figure 10:
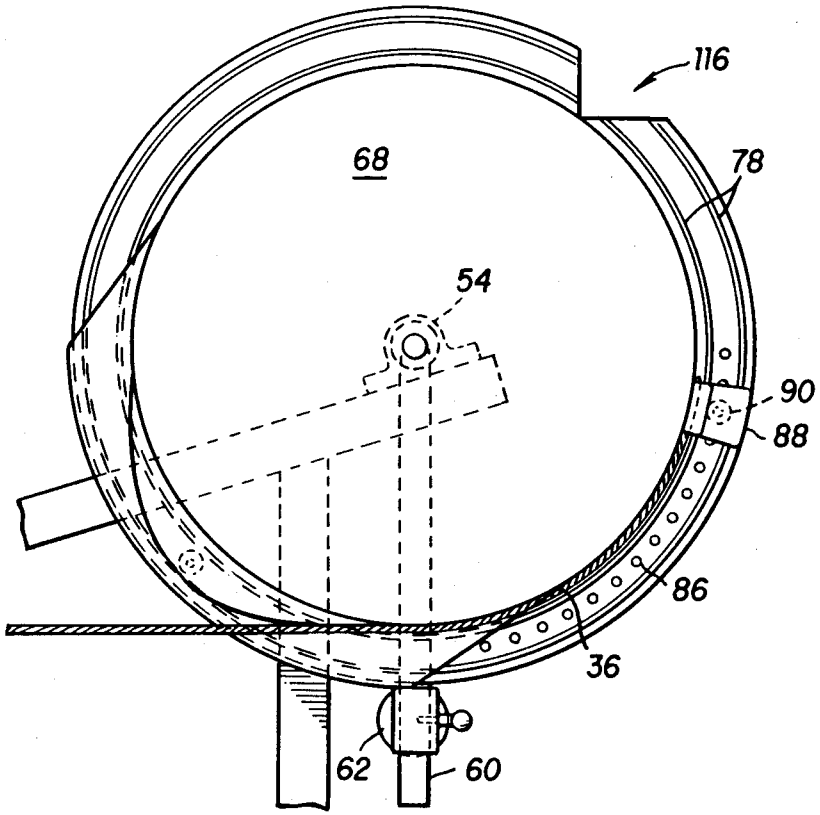
FIG. 10 is a detailed side elevation view of an alternative embodiment of the invention.

As will now be appreciated by those skilled in the art, apparatus 170 provides exercise benefit similar to those of the apparatus shown in FIGS. 12 and 13. As bar 162 is displaced, cable 158 rotates second cable wheel 156, thereby unwinding cable 158 therefrom, which, in turn, rotates shaft 154 to which first cable wheel 172 is secured to cause cable 144 to be wound thereon to lift weight support carriage 146. Moment arms 178 and 182, respectively, and first and second weights, 180 and 186, respectively, may be positioned in order to provide segments of increasing or decreasing resistance during the rotation of first cable wheel 172 in taking up cable 144 to lift the weight support carriage 146. In addition, I prefer to mount second cable wheel 156 on a separate shaft having a gear secured thereto and to mount first cable wheel 172, first moment arm 178 and second moment arm 182 on another shaft having a gear coupled to the corresponding gear on the other shaft to take advantage of the ratios provided thereby.

Figure 17:
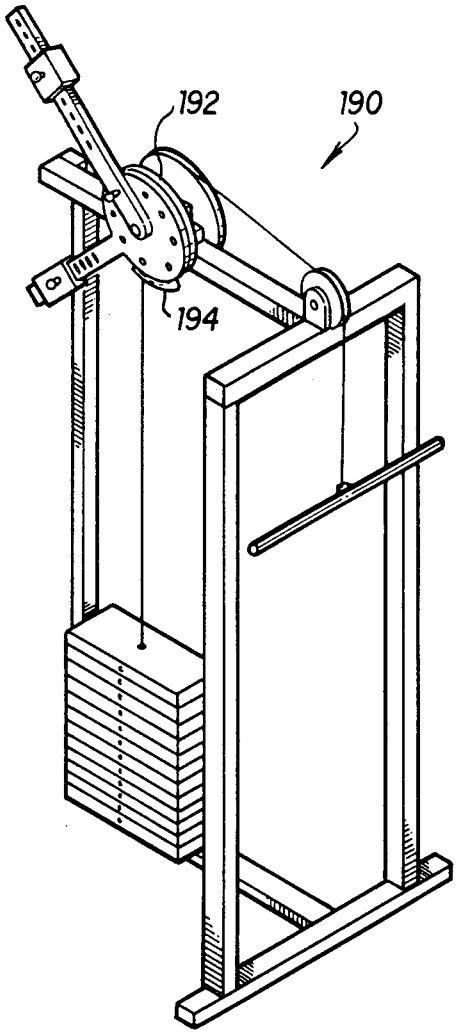
FIG. 17 is an isometric view of still another embodiment of the invention.

A modified version of apparatus 170 is shown in FIG. 17 as apparatus 190; again, like reference numerals refer to like components in FIG. 16. In apparatus 190, first cable wheel 172 is replaced by a modified cable wheel 192 which is similar to cable wheel 68 in that it may accept a supplemental cam member 194 for purposes and by means disclosed herein. As will now be appreciated, such apparatus will provide the flexibility in providing variable resistance patterns resulting from supplemental cam member 194 as well as first and second moment arms, 178 and 182, respectively. Again, the cable wheels may be on different shafts and be coupled by gears to provide a mechanical ratio therebetween.

Figure 2:
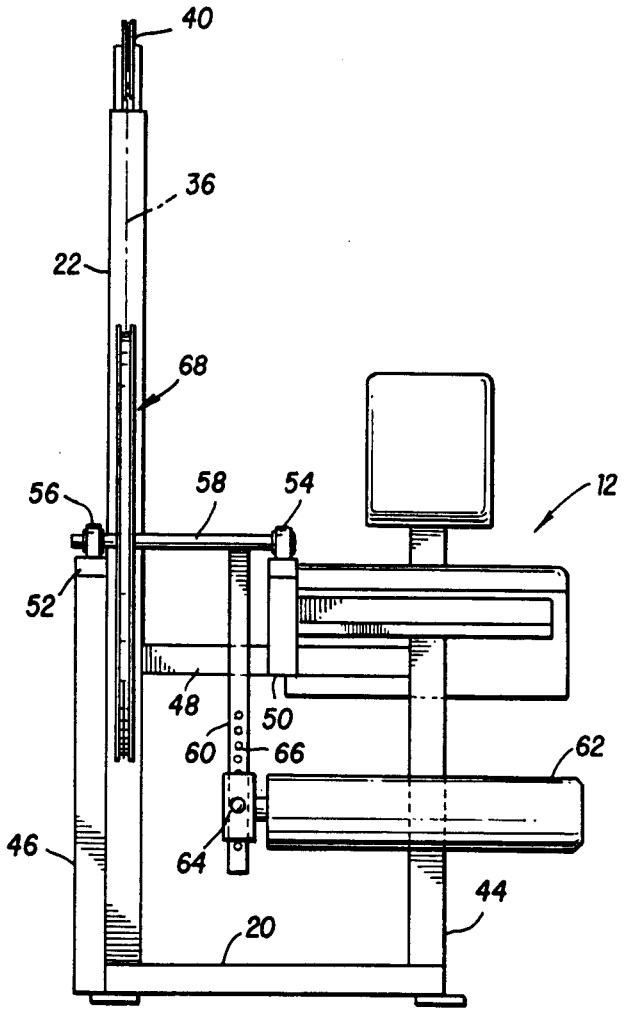
FIG. 2 is a front elevation view of the subject invention.
Figure 4:
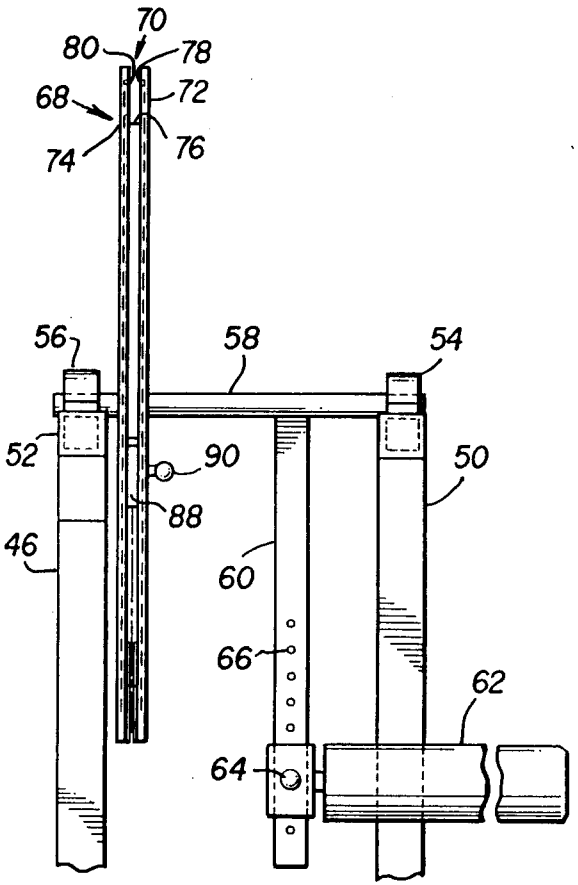
FIG. 4 is a detailed front elevation view of certain components of the invention.
Figure 18:
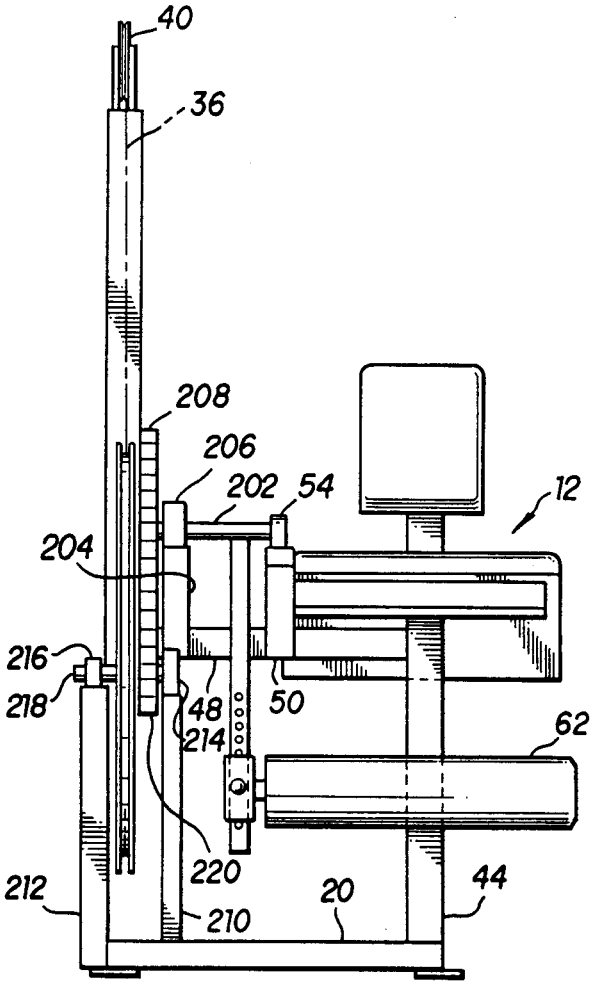
FIG. 18 is an additional embodiment of the present invention.

In another embodiment of the invention shown in FIG. 18, identified as 200, several similarities are borne relative to the apparatus shown in FIGS. 1 and 2; therefore, like reference numerals identify like components. In apparatus 200, shaft 202 replaces shaft 58 but continues to support bracket 60 and bearing member 62. However, support 204 is provided on member 48 to support a pillow block 206. Secured to shaft 202 outboard of pillow block 206 is a first gear 208. Additional supports 210 and 212, respectively, support third and fourth pillow blocks 214 and 216, respectively, which rotatably support a shaft 218. Shaft 218 carries a second gear 220 which is coupled to first gear 208. Also attached to shaft 218 is a cable wheel 220. Cable wheel 220 is preferably similar in all respects to cable wheel 68 discussed above and may include a supplemental cam member 221. In addition, the moment arms 126 and 134 may be provided to afford even greater flexibility in resistance pattern selection.

One advantage of apparatus 200 is that the gears 208 and 220 allow cable wheel 220 to traverse a greater arc for a given rotation of bearing member 62. As such, supplemental cam member 221 may provide a simple or multiple resistance enhancements to yield even greater flexibility in tailoring resistance patterns for muscle development and/or rehabilitation.

It will be understood that various changes in the details, materials and arrangements of parts which have been herein described and illustrated in order to explain the nature of the invention may be made by those skilled in the art within the principle and scope of the invention as expressed in the appended claims.

What is claimed is:

1. Weight lifting exercise apparatus comprising:

a. a support frame;

b. weight support carriage means vertically moveable within said support frame for detachably securing a plurality of weight members;

c. cable guide means supported by said support frame;

d. a cable segment secured at one end to said weight support carriage means and extending through said cable guide means;

e. a horizontal shaft rotatably supported on said frame;

f. a bearing member attached to said shaft for engagement by a user to rotate said shaft;

g. a cable wheel mounted on said shaft for rotation therewith, said cable being attached at its other end to a point on said cable wheel, said cable wheel having an arcuate cable receiving surface onto which said cable segment may be wound by the rotation of said shaft by a user rotating said bearing member, with a point of tangency being defined where said cable separates from said cable receiving surface to thereby define a radius of tangency; and h. a supplemental cam member having a supplemental cable receiving surface, said cam member being attachable to said cable wheel so that said supplemental cable receiving surface may overlie at least a portion of said cable receiving surface to define a modified cable receiving surface which presents radii of tangency during rotation of said cable wheel which are greater than the radii of tangency presented by said cable receiving surface.

2. Apparatus of claim 1 in which said cable wheel comprises a cable guide channel having upstanding walls laterally adjacent to said cable receiving surface.

3. Apparatus of claim 2 in which said supplemental cam member comprises:

a. a body member which may be received within said cable guide channel; and b. a supplemental cable guide channel having upstanding walls laterally adjacent to said supplemental cable receiving surface.

4. Apparatus of claim 3 further comprising means for fixing the circumferential position of said supplemental cam member, comprising:

a. a plurality of apertures in said cable wheel spaced about the periphery thereof; and b. pop pin means attached to said body member and having a pin which may engage a predetermined aperture among said plurality of apertures.

5. Apparatus of claim 4 further comprising:

a. circumferential guide grooves formed in said upstanding walls of said cable guide channel; and b. guide members formed in said body member for engagement with said guide grooves.

6. Apparatus of claim 1 in which said supplemental cam member comprises a supplemental cable receiving surface having more than one point of maximum radius of tangency.

7. Apparatus of claim 1 further comprising a second supplemental cam member having a second supplemental cable receiving surface, said second supplemental cam member being attachable to said supplemental cam member so that said second supplemental cable receiving surface overlies a portion of said supplemental cable receiving surface to define a further modified cable receiving surface.

8. Apparatus of claim 1 further comprising:

a. a first moment arm rotatably supported on said shaft adjacent to said cable wheel;

b. means for attaching said first moment arm to said cable wheel; and c. a first weight member supported on said first moment arm.

9. Apparatus of claim 8 further comprising:

a. a second moment arm rotatably supported on said shaft adjacent to said first moment arm;

b. means for attaching said second moment arm to said first moment arm; and c. a second weight member supported on said second moment arm.

10. Apparatus of claim 9 in which said means for attaching said first moment arm to said cable wheel comprises:

a. a first plurality of apertures provided at an inner radius on said cable wheel; and b. a first pop pin on said first moment arm, said first pop pin having a pin member which may engage one of said first plurality of apertures.

11. Apparatus of claim 10 in which said means for attaching said second moment arm to said first moment arm comprises:

a. a disk rotatably mounted on said shaft and from which said first moment arm extends, said disk having a second plurality of circumferential apertures therein; and b. a second pop pin on said second moment arm, said second pop pin having a pin member which may engage one of said second plurality of apertures.

12. Apparatus of claim 11 in which said first weight member is attachable at selected positions along said first moment arm and said second weight member is attachable at selected positions along said second moment arm.

13. Apparatus of claim 1 further comprising means for varying the location at which said other end of said cable is attached to said cable wheel.

14. Weight lifting exercise apparatus comprising:

a. a support frame;

b. weight support carriage means vertically moveable within said support frame for detachably securing a plurality of weight members;

c. a first cable wheel mounted on a rotatable shaft on said support frame, said first cable wheel comprising a first cable receiving surface;

d. a first cable segment attached at one end to said weight support carriage and at its other end to said first cable wheel so that said first cable segment may be wound onto said first cable wheel;

e. a second cable wheel mounted on said shaft and having an arcuate second cable receiving surface;

f. cable guide means mounted on said support frame;

g. a bearing member which may be engaged by a user;

h. a second cable segment attached at one end to said bearing member, passing through said cable guide means, wound around a portion of said second cable receiving surface and attached at its other end to a point on said second cable wheel, so that said second cable segment may be unwound from said second cable wheel when said first cable segment is wound onto said first cable receiving surface; and i. a supplemental cam member having a supplemental cable receiving surface, said cam member being attachable to said first cable wheel so that said supplemental cable receiving surface may overlie at least a portion of said cable receiving surface to define a modified cable receiving surface.

15. Apparatus of claim 14 in which said first cable wheel comprises a cable guide channel having upstanding walls laterally adjacent to said cable receiving surface.

16. Apparatus of claim 15 in which said supplemental cam member comprises:

a. a body member which may be received within said cable guide channel; and b. a supplemental cable guide channel having upstanding walls laterally adjacent to said supplemental cable receiving surface.

17. Apparatus of claim 16 further comprising means for fixing the circumferential position of said supplemental cam member, comprising:

a. a plurality of apertures in said first cable wheel spaced about the periphery thereof; and b. pop pin means attached to said body member and having a pin which may engage a predetermined aperture among said plurality of apertures.

18. Apparatus of claim 17 further comprising:

a. circumferential guide grooves formed in said upstanding walls of said cable guide channel; and b. guide members formed in said body member for engagement with said guide grooves.

19. Weight lifting exercise apparatus comprising:

a. a support frame;

b. weight support carriage means vertically moveable within said support frame for detachably securing a plurality of weight members;

c. cable guide means supported by said support frame;

d. a cable segment secured at one end to said weight support carriage means and extending through said cable guide means;

e. a first horizontal shaft rotatably supported on said frame;

f. a bearing member attached to said shaft for engagement by a user to rotate said shaft;

g. a first gear means attached to said first shaft for rotation therewith;

h. a second horizontal shaft rotatably supported on said frame;

i. a second gear means attached to said second shaft for rotation therewith, said second gear means being coupled to said first gear means;

j. a cable wheel mounted on said second shaft for rotation therewith, said cable being attached at its other end to a point on said cable wheel, said cable wheel having an arcuate cable receiving surface onto which said cable segment may be wound by the rotation of said shaft by a user rotating said bearing member, with a point of tangency being defined where said cable separates from said cable receiving surface to thereby define a radius of tangency; and k. a supplemental cam member having a supplemental cable receiving surface, said cam member being attachable to said cable wheel so that said supplemental cable receiving surface may overlie at least a portion of said cable receiving surface to define a modified cable receiving surface which presents radii of tangency during rotation of said cable wheel which are greater than the radii of tangency presented by said cable receiving surface.

20. Weight lifting exercise apparatus comprising:

a. support frame;

b. weight support carriage means vertically moveable within said support frame for detachably securing a plurality of weight members;

c. a first cable wheel mounted on a first rotatable shaft on said support frame, said first cable wheel comprising a first cable receiving surface;

d. a first cable segment attached at one end to said weight support carriage and at its other end to said first cable wheel so that said first cable segment may be wound onto said first cable receiving surface;

e. a first gear means attached to said first shaft for rotation therewith;

f. a second cable wheel mounted on a second rotatable or said support frame, said second cable wheel having an arcuate second cable receiving surface;

g. a second gear means attached to said second shaft for rotation therewith, said second gear means being coupled to said first gear means;

h. cable guide means mounted on said support frame;

i. a bearing member which may be engaged by a user;

j. a second cable segment attached at one end to said bearing member, passing through said cable guide means, wound around a portion of said second cable receiving surface and attached at its other end to a point on said second cable wheel so that second cable segment may be unwound from said second cable wheel when said first cable segment is wound onto said first cable receiving surface; and k. a supplemental cam member having a supplemental cable receiving surface, said cam member being attachable to said first cable wheel so that said supplemental cable receiving surface may overlie at least a portion of said first cable receiving surface to define a modified cable receiving surface.

* * * * *